US005094484A

United States Patent [19]

Bang

[11] Patent Number: 5,094,484

[45] Date of Patent: Mar. 10, 1992

[54] LOCKING APPARATUS

[75] Inventor: Doo-Jin Bang, Inchon, Rep. of Korea

[73] Assignee: SamSung Electronics Co., Ltd., Ki-Do, Rep. of Korea

[21] Appl. No.: 580,529

[22] Filed: Sep. 11, 1990

[30] Foreign Application Priority Data

Sep. 12, 1989 [KR] Rep. of Korea ..... 1989-13530

[51] Int. Cl.[5] ..... B41F 3/20

[52] U.S. Cl. ..... 292/120; 101/269

[58] Field of Search ..... 292/120, 116, 218, 121, 292/128, 350, 101, DIG. 69

[56] References Cited

U.S. PATENT DOCUMENTS

| | | | |
|---|---|---|---|
| 670,797 | 3/1901 | Lyons | 292/120 |
| 1,100,820 | 6/1914 | Edwards | 292/218 |
| 1,334,610 | 3/1920 | Hope et al. | 292/202 |
| 1,597,079 | 8/1926 | Kugley | 292/218 |
| 2,038,876 | 4/1936 | Sonabend | 292/218 |
| 2,793,722 | 5/1957 | Bingham | 292/128 X |
| 3,735,701 | 5/1973 | Ackerman | 292/128 X |
| 4,667,271 | 5/1987 | Wilson | 292/218 X |

*Primary Examiner*—Richard E. Moore
*Attorney, Agent, or Firm*—Robert E. Bushnell

[57] ABSTRACT

An improvement of locking lever for use in office automation apparatuses such as a facsimile, a laser printer, a copying machine, etc. The improvement includes a lever having two end portions, for transferring power; a knob mounted fixedly on a central portion of the lever, for rotating the lever in a given direction of locking/unlocking the locking apparatus; and a pair of locking metals attached to the two end portions, for isolating the locking metals onto an object encountered.

2 Claims, 1 Drawing Sheet

LOCKING APPARATUS

BACKGROUND OF THE INVENTION

This invention relates generally to an improvement of a locking lever for use in office automatic machines such as a facsimile, a laser printer, a copying machine, etc. In particular, this invention relates to a locking lever which is able to prevent a crooked discharge of copying paper transferring currently.

A conventional locking lever in general includes a lever having two end portions, a pair of locking metals respectively attached to the two end portions, and an operating knob mounted on a locking metal leaning toward any one of the two end portions. The interconnection of the locking metals and the end portions of the lever is strengthened by a tightening screw. In such a conventional locking lever, the rotational moment of the locking metal positioned contiguously to the operation knob may differ from that of the other locking metal apart from the operation knob, so that the locking may not be uniform and unstable which causes from time to time crooked discharge of copying paper.

SUMMARY OF THE INVENTION

Accordingly, it is an object of the present invention to provide a locking lever which equalizes the rotational moments of both the locking metals thereof.

It is another object of the present invention to provide a locking lever which secures a proper loading and discharge of copying paper by distributing the pressure of the locking lever uniformly regardless of position.

According to the present invention, a locking apparatus includes: a lever having two end portions, for transferring power; a knob mounted fixedly on a central portion of the lever, for rotating the lever in a given direction of locking/unlocking the locking apparatus; and a pair of locking metals respectively attached to the two end portions, for isolating the locking metals onto an object encountered.

BRIEF DESCRIPTION OF THE DRAWINGS

For a better understanding of the invention and to show how the same may be carried into effect, reference will now be made, by way of example, to the accompanying diagrammatic drawings, in which.

DETAILED DESCRIPTION OF THE PREFERRED EMBODIMENT

The present invention will now be described in detail with reference to the drawings attached herewith only by way of an example.

Figure 2:
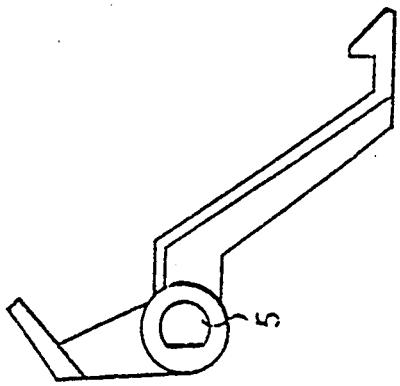
FIG. 2 illustrates a right side view of the locking lever described in FIG. 1.
Figure 1:
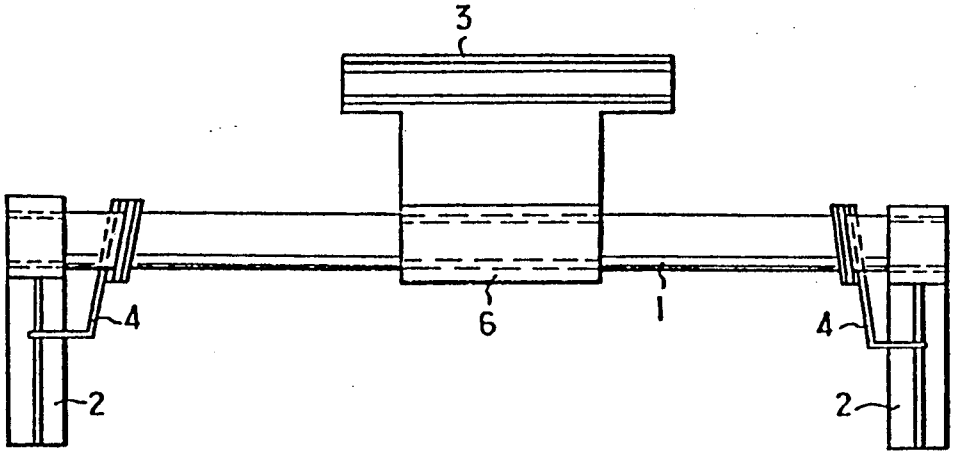
FIG. 1 illustrates a front view for schematizing a locking lever according to the present invention.

With particular reference to FIGS. 1 and 2, lever 1 has two end portions 5, on which locking metals 2 are mounted. It is noted from the drawings that the two end portions have a D-shaped cross-section respectively so as to be fitted into corresponding D-shaped through holes 6 of the locking metals 2. Likewise, operating knob 3 is fitted with the central portion of the lever 1. In order to bias the locking metals 2 towards the locking direction, coil springs 4 are provided, of which the end portion is respectively supported by the locking metals 2, and of which the body portions are respectively mounted on the lever 1 contiguous to the two end portions thereof.

In this way, the locking metals 2 are directly fixedly attached to the end portions 5 of the lever 1 without using any additional fastening means, thereby simplifying the structure. Furthermore, since the knob 3 is attached to the central portion of the lever 1, the rotational force delivered from the knob 3 is provided equally to the each locking metal 2 mounted on each end portion 5 of the lever 1. Consequently, the locking and releasing operation of the lever 1 is precisely controlled, thereby stabilizing the operation of the locking means even though long used.

Although specific constructions and procedures of the invention have been illustrated and described herein, it is not intended that the invention be limited to the elements and constructions disclosed. One skilled in the art will easily recognize that the particular elements or subconstructions may be used without departing from the scope and spirit of the invention.

What is claimed is:

1. A locking apparatus, comprising:

a lever having two axially opposite end portions;

a knob mounted fixedly on a central portion of said lever, for rotating said lever in directions of locking or unlocking said locking apparatus;

said knob comprising;

a circumferential portion, engaging the central portion of said lever;

an outwardly extending portion having longitudinal opposite distal ends; and an intermediate portion spaced apart form said distal ends, joining said circumferential portion and said outwardly extending portion;

a pair of discrete arms attached to said lever to simultaneously engage an object encountered as said knob causes said lever to rotate said arms in a locking direction, wherein said end portions have a D-shaped cross-section corresponding to conforming apertures coaxially extending into respective ones of said arms;

said arms comprising:

a flange providing an elongated broad surface terminating in an inwardly directed claw defining a recess between said claw and said flange; and a web adjoining the length of said flange along the side of said flange opposite the elongated abroad surface;

a pair of springs, wherein a body portion of each of said springs is attached to said lever contiguous to said end portions, and an end portion of each of said springs is attached to said arms, thereby biasing said arms in the locking position.

2. A locking apparatus, comprising:

a lever having two axially opposite end portions, each of said end portions having a conforming surface;

means mounted on a central portion of said lever, for rotating said lever in directions of locking or unlocking said locking apparatus, said rotating means comprising:

a circumferential portion, engaging the central portion of said lever;

an outwardly extending portion having longitudinal opposite distal ends; and an intermediate portion spaced apart from said distal ends, joining said circumferential portion and said outwardly extending portion;

a pair of discrete arms attached to said lever to simultaneously engage an object encountered as said rotating means causes said lever to rotate said arms in a locking direction, said arms each having an aperture shaped to receive a different respective said conforming surface;

said arms comprising;

a flange providing an elongated broad surface terminating in an inwardly directed claw defining a recess between said claw and said flange;

a web adjoining the length of said flange along the side of said flange opposite the elongated abroad surface; and a pair of springs, wherein a body portion of each of said springs is attached to said lever contiguous to said end portions, and an end portion of each of said springs is attached to said arms, thereby biasing said arms toward the locking position.

* * * * *

UNITED STATES PATENT AND TRADEMARK OFFICE

CERTIFICATE OF CORRECTION

PATENT NO. : 5,094,484

DATED : March 10, 1992

INVENTOR(S) : Doo-Jin Bang

It is certified that error appears in the above-indentified patent and that said Letters Patent is hereby corrected as shown below:

Column 1, line 23, delete "causes".

Signed and Sealed this

Twenty-sixth Day of September, 1995

*Attest:*

BRUCE LEHMAN

*Attesting Officer*

*Commissioner of Patents and Trademarks*